United States Patent [19]

Parmentier

[11] Patent Number: 4,487,146

[45] Date of Patent: Dec. 11, 1984

[54] SAIL BATTEN

[76] Inventor: Jan A. Parmentier, Enschedestraat 300, Hengelo, Netherlands

[21] Appl. No.: 467,989

[22] Filed: Feb. 18, 1983

[30] Foreign Application Priority Data

Feb. 23, 1982 [NL] Netherlands ..... 8200716

[51] Int. Cl.[3] ..... B63H 9/04

[52] U.S. Cl. ..... 114/102

[58] Field of Search ..... 114/102, 103, 104, 39

[56] References Cited

U.S. PATENT DOCUMENTS

| | | | |
|---|---|---|---|
| 2,608,172 | 8/1952 | Biuw | 114/103 |
| 3,581,698 | 6/1971 | Bete | 114/102 |
| 3,905,321 | 9/1975 | Blythe, Jr. | 114/103 |

*Primary Examiner*—Sherman D. Basinger
*Assistant Examiner*—Jesûs D. Sotelo
*Attorney, Agent, or Firm*—Karl W. Flocks; Sheridan Neimark

[57] ABSTRACT

A batten which is made of a plastic profile, that seen on a transverse sectional view, consists of several cavities next to one another, in order to hold close fitting inserts. In this manner it can be obtained that the stiffness of the batten is changing gradually, because the reinforcing inserts in the cavities have a different length. The stiffness of the batten can be changed in a simple way and right along its full length. The profile and rod-like inserts are substantially constant in cross-sectional dimension throughout their length and consequently easy and cheap to manufacture.

11 Claims, 4 Drawing Figures

SAIL BATTEN

This invention relates to a batten (lath), in particular a sail batten to be used as stiffening in a sail, such as the sail of a sailsurfing board, a yacht or the like.

The generally known sail battens have the configuration of a strip or profile of solid material, in particular made of glass fibre reinforced polyester.

A drawback of these well known sail battens is, that they have proved to be rather stiff. This in particular applies to battens with the same cross section along their length. The improved tapered sail battens however are in some cases not stiff enough on one end and too stiff on the other end.

This to such a degree that an optimum effect with these battens can only be obtained at certain wind velocities or sail positions.

An additional drawback of such sail battens is, that they possess a higher density or specific gravity than water, with the result that they will sink in case they are lost during sailing.

Another great disadvantage of the tapered type of said batten is, that they have proved to be very difficult to manufacture and it is consequently very expensive.

It is true that it would be possible to adapt the stiffness of the well known sail battens to the recognized requirements, by changing their cross section, but then the user has no further possibilities for experimenting, whereas sail battens with reduced cross sections will be held less firmly in the sail and consequently might be lost more easily.

This invention now aims to provide a sail batten, of which the stiffness can be changed in a simple way and right along the full length of the said batten too.

In this invention it is attained, because the batten consists of a profile with at least one longitudinal cavity, in order to hold a close fitting elongated insert, which consists of e.g. a small diameter rod or tube out of glass fibre reinforced polyester, aluminum or the like. The cross sections of the cavity and insert are adapted to each other in such a way, that the insert in the cavity, is only movable in longitudinal direction.

The insert cannot or hardly leave the cavity in transverse direction, but can be moved in longitudinal direction of the sail batten, so that the stiffness of the sail batten can be altered by putting in or telescoping in the afore mentioned insert. In case an elongated rod-like reinforcing member extends along the full length, the sail batten will possess its maximum stiffness, whereas by completely omitting the insert the batten possesses its minimum stiffness. Intermediate graduations of stiffness of the sail batten can be obtained if an insert, which does not extend along the full length of the sail batten, is telescoped into the cavity.

According to a further form of the invention, it has been provided for that seen on a transverse sectional view of the batten, a number of cavities have been positioned next to one another.

In this manner it can be obtained that the stiffness of the batten is changing gradually along its length, because the inserts, which are telescoped into the cavities have a different length.

According to a further form of the invention, the cavities in the sail batten will possess a cross section which is closed in itself and the inserts will be rod or tube like.

In this manner, it is obtained that the inserts are held inside the cavities in such a way, that the inserts will not move inside or leave the cavities during normal use of the sail battens.

The cavities in particular will herewith have a mainly right-angled internal cross section and the inserts around external cross section. The cavities with the short sides are adjacent to one another.

The diameter of the inserts will herewith be adapted to the smallest dimensions of the cavities, so that a satisfactory tight fit of the inserts in the cavities can easily be obtained.

According to yet another form of the invention, the inserts can be tapered for at least part of their length, so that, consequently, a further adjustment of the stiffness of the sail batten can be made and also in such a way, that the part of the batten of which the radius of curvature is the smallest should be located nearer to the mast than to the aft leech.

By preference, the sail battens will be manufactured out of polyvinylchloride, polyester, polypropylene or similar materials. In manufacturing sail battens for big yachts one could however also make use of glass fibre reinforced polyester, polyamide, (nylon), polycarbonate or similar materials, in which other reinforcing fibres can be used too, such as Kevlar, carbon fibre or similar materials. These techniques can of course be applied to the rigging of any small vessel too.

In connection with the dimensions of the cavities, water will hardly be able to penetrate into these, whereas the penetration of water can also be prevented further by telescoping complementary end caps over the ends of the sail batten. These end caps also prevent damage to the ends of the battens and to the sail. In connection herewith, the corners and edges of the sail batten will generally be rounded off.

Although, certainly in the last case, the specific weight of the materials is higher than that of water, the completed batten displaces considerably more volume than the volume of an equal weight amount of water, thus rendering the batten buoyant. This is because of the cavities, which are not filled or partly filled by the inserts. Moreover extra cavities could be provided just for buoyancy only.

The invention is now explained further on the basis of examples of different configurations, as illustrated in the drawing, in which.

Figure 1:
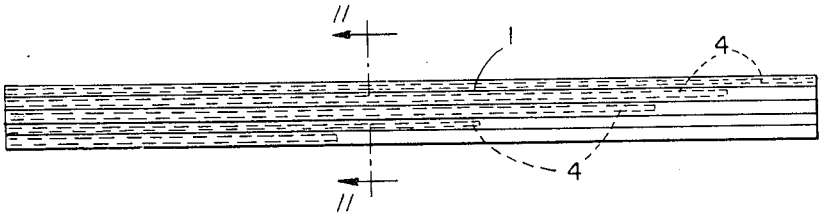
FIG. 1 shows a side elevation of a sail batten according to the invention.
Figure 2:
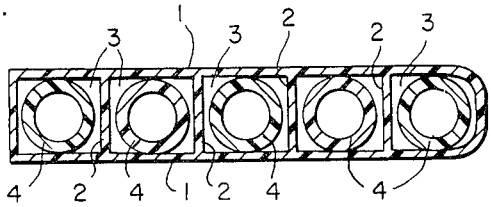
FIG. 2 is an enlarged transverse vertical sectional view taken substantially upon the plane, indicated by the section line II—II of FIG. 1.

The sail batten as illustrated in the FIGS. 1 and 2 comprises the upper and lower sides 1, with in between the transverse partitions or ribs 2, by which an amount of cavities 3, in this case five, is obtained.

Figure 4:
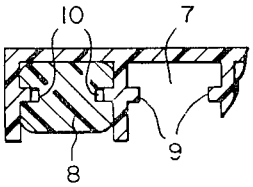
FIG. 4 shows a fragmentary enlarged transverse vertical sectional view of a different configuration of the sail batten according to the invention.

An insert 4 is telescoped into each cavity 3, but the inserts, which in FIG. 4 are illustrated with dash lines, do not all fully extend along the full length of the batten.

As a result of the latter, such a batten will bend under a load, transverse in the direction in which it is illustrated in FIG. 1. From its straight shape without load, illustrated in FIG. 3 with the line 5, the batten will be bent approximately according to the line 6 of FIG. 3.

Figure 3:
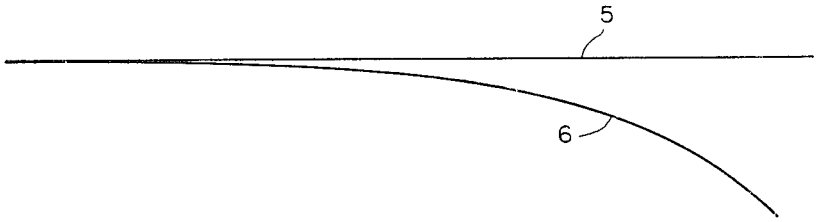
FIG. 3 shows a schematic top view of the sail batten according to FIG. 1 in the state without load (5) and in the state under load (6)

The radius of curvature per unit of length will namely be smaller from left to right, as seen in the FIGS. 1 and 3, since in that direction the stiffness of the batten is decreasing gradually. The gradual increasing flexibility provides a proper air foil shape to the batten.

It will be clear, that by applying other lengths of the inserts 4, different bending profiles as illustrated in FIG. 3 can be obtained.

On the right side in FIG. 2 is designated that the corners of the sail batten can be rounded off, so that possible damage to the sail is avoided.

Additionally FIG. 4 shows the possibility of the use of open apertures 7, in order to hold either solid or other inserts 8. The side walls of the cavities 7 are for that purpose provided with protruding parts 9, which are held in the slots 10 of the insert 8.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

Although in the previous lines a sail batten has been mentioned, a batten, box girder, pipe or profile according to the present invention could perhaps also be used for other purposes, for which it is desired to adjust the flexibility of the batten, box girder, pipe or profile.

Besides, the invention can also be applied to pipes, of which the wall then consists of an amount of holes, cells or cavities as these are e.g. illustrated in the FIGS. 2 and 4 and which cells are then arranged in a circle.

All these possibilities will be clear to the expert.

What is claimed is:

1. A batten, in particular in order to be used as stiffening in a sail, such as that of a sailsurfing board, a yacht or the like, said batten consisting of a profile in which, as seen on a transverse sectional view of the batten, a number of cavities have been arranged next to one another in order to each hold a close fitting elongated insert, the cross section of the cavity and insert being adapted to each other in such a way that the insert in the cavity is only movable in a longitudinal direction.

2. A batten as set forth in claim 1, in which the cavities in the batten possess a cross section which is closed in itself and the inserts are rod or tube like.

3. A batten as set forth in claim 2, said batten being manufactured out of polyvinylchloride, polyester, polypropylene, polycarbonate or similar materials.

4. A batten as set forth in claim 2, comprising a pair of complementary end caps being telescoped over the ends of the sail batten.

5. A batten as set forth in claim 1 which is buoyant.

6. A batten, in particular in order to be used as stiffening in a sail, such as that of a sailsurfing board, a yacht or the like, said batten comprising a profile with a number of longitudinal cavities in each of which a close fitting elongated insert element can be shifted, said elements having a length which corresponds with or is smaller than the length of said profile, said cavities having the same cross-sectional shape which shape substantially is not changed by the insertion of an element in it.

7. A batten as set forth in claim 6, in which, as seen in a cross-sectional view of the batten, the various cavities are arranged next to one another and possess a cross-section which is closed in itself, the insert elements having the shape of a rod or tube.

8. A batten as set forth in claim 7, in which the cavities mainly have a right-angled internal cross-section and the insert element a round external cross-section, said cavities being arranged such that the smallest sides of said cavities are forming the common sides of two adjacent cavities.

9. A batten, in particular in order to be used as stiffening in a sail, such as that of a sailsurfing board, a yacht or the like, said batten comprising an elongated profile wth a plurality of longitudinal cavities, each cavity being adapted to hold a close fitting elongated reinforcing insert, the cross section of the cavity and insert being adapted to each other in such a way that the insert in the cavity is only movable in the longitudinal direction, said insert being insertable and removable to vary the stiffness of the batten at different longitudinal positions thereof.

10. A batten as set forth in claim 9 wherein each said cavity has a closed rectangular cross section.

11. A batten as set forth in claim 9 in which the profile of the batten is substantially constant in cross sectional dimension throughout its length.

* * * * *